US012559687B2

(12) United States Patent
Chishima et al.

(10) Patent No.: US 12,559,687 B2
(45) Date of Patent: Feb. 24, 2026

(54) FUEL PRODUCTION SYSTEM AND FUEL PRODUCTION METHOD

(71) Applicant: HONDA MOTOR CO., LTD., Tokyo (JP)

(72) Inventors: Hiroshi Chishima, Saitama (JP); Kohtaro Hashimoto, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 199 days.

(21) Appl. No.: 18/479,121

(22) Filed: Oct. 2, 2023

(65) Prior Publication Data

US 2024/0110108 A1 Apr. 4, 2024

(30) Foreign Application Priority Data

Oct. 4, 2022 (JP) ..... 2022-160437

(51) Int. Cl.
*C25B 1/04* (2021.01)
*C10G 2/00* (2006.01)
(Continued)

(52) U.S. Cl.
CPC ..... *C10G 2/30* (2013.01); *C10J 3/16* (2013.01); *C10J 3/723* (2013.01); *C25B 1/04* (2013.01);
(Continued)

(58) Field of Classification Search
CPC ..... C10G 2/30; C10G 2300/42; C10J 2300/0916; C10J 2300/0959;
(Continued)

(56) References Cited

U.S. PATENT DOCUMENTS

2021/0292664 A1 9/2021 Chishima
2021/0292665 A1 9/2021 Chishima

FOREIGN PATENT DOCUMENTS

CN 105308154 B * 11/2018 ..... C10K 3/06
JP 2002003864 A 1/2002
(Continued)

OTHER PUBLICATIONS

Notification of Reasons for Refusal issued Jun. 18, 2024 in the JP Patent Application No. JP2022-160437.

*Primary Examiner* — Ellen M Mcavoy
*Assistant Examiner* — Chantel Graham
(74) *Attorney, Agent, or Firm* — CKC & Partners Co. LLC

(57) ABSTRACT

A fuel production system and a fuel production method are provided which can efficiently perform adjusting of a synthesis gas composition by hydrogen supply, while suppressing the generated amount of carbon dioxide by a system overall. A fuel production system includes: a gasification furnace which gasifies a biomass raw material to generate a synthesis gas containing hydrogen and carbon monoxide; a liquid fuel production device which produces a liquid fuel from the synthesis gas generated by the gasification furnace; a hydrogen supply pump which supplies hydrogen to a raw material supply area or a synthesis gas discharge area; a byproduct sensor which detects a byproduct amount generated inside the gasification furnace; and a controller which switches a hydrogen supply location by the hydrogen supply pump between the raw material supply area and synthesis gas discharge area, based on the byproduct amount detected by the byproduct sensor.

7 Claims, 7 Drawing Sheets

(51) Int. Cl.
*C10J 3/16* (2006.01)
*C10J 3/72* (2006.01)

(52) U.S. Cl.
CPC ... *C10G 2300/42* (2013.01); *C10J 2300/0916* (2013.01); *C10J 2300/0959* (2013.01); *C10J 2300/0966* (2013.01); *C10J 2300/0973* (2013.01)

(58) Field of Classification Search
CPC ..... C10J 2300/0966; C10J 2300/0973; C10J 2300/1659; C10J 2300/1665; C10J 2300/1684; C10J 3/00; C10J 3/16; C10J 3/723; C10K 1/004; C10K 1/08; C25B 1/04
See application file for complete search history.

(56) References Cited

FOREIGN PATENT DOCUMENTS

| | | | |
|---|---|---|---|
| JP | 2002012877 | A | 1/2002 |
| JP | 2021147504 | A | 9/2021 |
| JP | 2021147506 | A | 9/2021 |

* cited by examiner

FUEL PRODUCTION SYSTEM AND FUEL PRODUCTION METHOD

This application is based on and claims the benefit of priority from Japanese Patent Application No. 2022-160437, filed on 4 Oct. 2022, the content of which is incorporated herein by reference.

BACKGROUND OF THE INVENTION

Field of the Invention

The present invention relates to a fuel production system and a fuel production method. In more detail, it relates to a fuel production system and a fuel production method which produce a liquid fuel based on a biomass raw material and renewable energy.

Related Art

In recent years, as a substitute for fossil fuels, electrically synthesized fuels have gained attention which are made with hydrogen produced using electricity generated from renewable energy and a carbon source such as biomass or carbon dioxide discharged from factories.

A general sequence of producing liquid fuel such as methanol and gasoline with biomass as the raw material is as follows. In other words, a liquid fuel is produced from a biomass raw material through a gasifying step of gasifying a biomass raw material subjected to a predetermined pretreatment together with water and oxygen in a gasification furnace to generate a synthesis gas containing hydrogen and carbon monoxide; a scrubbing step of scrubbing the generated synthesis gas to remove tar; a $H_2$/CO ratio adjusting step of adjusting the $H_2$/CO ratio of the synthesis gas subjected to the scrubbing step to a target ratio according to a liquid fuel sought to be produced; a desulfurizing step of removing sulfur components from the synthesis gas subjected to the $H_2$/CO ratio adjusting step; and a fuel producing step of producing the liquid fuel from the synthesis gas subjected to the desulfurizing step.

Herein, $H_2$/CO of the synthesis gas generated through a gasifying step does not achieve the target ratio in most cases, and enters a hydrogen deficient state. Patent Document 1 discloses technology for adjusting the $H_2$/CO ratio of synthesis gas discharged from a gas furnace, by supplying hydrogen generated by an electrolyzer generating hydrogen from water using a renewable energy into a gas furnace or a raw material supply path of a biomass raw material. According to the technology disclosed in Patent Document 1, it is possible to suppress the generated amount of carbon dioxide in the overall fuel production system.

Patent Document 1: Japanese Unexamined Patent Application, Publication No. 2021-147504

SUMMARY OF THE INVENTION

However, there are cases where the proportion of supplied hydrogen being consumed in the generation of byproducts increases according to the operating conditions of the gasification furnace, and an improvement in the production efficiency of different fuels has been demanded.

The present invention has an object of providing a fuel production system and a fuel production method which can efficiently perform adjustment of synthesis gas composition by hydrogen supply, while suppressing the generated amount of carbon dioxide by the overall system. Then, consequently it contributes to higher efficiency in energy.

A fuel production system for producing a liquid fuel from a biomass raw material (for example, the fuel production system 1 described later) according to a first aspect of the present invention includes: a gasification furnace (for example, the gasification furnace 30 described later) which gasifies a biomass raw material to generate a synthesis gas containing hydrogen and carbon monoxide; a liquid fuel production device (for example, the liquid fuel production device 4 described later) which produces a liquid fuel from the synthesis gas generated by the gasification furnace; a hydrogen supply device (for example, the hydrogen supply pump 64 described later) which supplies hydrogen to a raw material supply area (for example, the raw material supply area A described later) including inside the gasification furnace and inside a raw material supply path (for example, the raw material supply path 20 described later) of biomass raw material leading to the gasification furnace, or a synthesis gas discharge area (for example, the synthesis gas discharge area B described later) at which the synthesis gas is discharged from the gasification furnace; a byproduct detector (for example, the byproduct sensor 313 described later) which detects a byproduct amount generated within the gasification furnace; and a controller (for example, the controller 7 described later) which switches a hydrogen supply location by the hydrogen supply device between the raw material supply area and the synthesis gas discharge area, based on the byproduct amount detected by the byproduct detector.

According to a second aspect of the present invention, in the fuel production system as described in the first aspect, the controller switches a hydrogen supply location by the hydrogen supply device from the raw material supply area to the synthesis gas discharge area, when a byproduct amount detected by the byproduct detector is at least a predetermined value.

According to a third aspect of the present invention, in the fuel production system as described in the first aspect, the controller switches a hydrogen supply location by the hydrogen supply device from the raw material supply area to the synthesis gas discharge area, when a byproduct amount per unit time detected by the byproduct detector is at least a predetermined value.

According to a fourth aspect of the present invention, the fuel production system as described in the first aspect further includes: a carbon monoxide detector (for example, the CO sensor 312 described later) which detects a carbon monoxide amount generated in the gasification furnace, in which the controller switches a hydrogen supply location by the hydrogen supply device from the raw material supply area to the synthesis gas discharge area, when a ratio of carbon monoxide amount per unit time detected by the carbon monoxide detector relative to a byproduct amount per unit time detected by the byproduct detector is at least a predetermined value.

According to a fifth aspect of the present invention, the fuel production system as described in any one of the first to fourth aspects further includes: an electrolyzer (for example, the electrolyzer 60 described later) which generates hydrogen from water by way of electrical power generated using a renewable energy, in which the hydrogen supply device supplies the hydrogen generated by the electrolyzer to the raw material supply area or the synthesis gas discharge area.

According to a sixth aspect of the present invention, in the fuel production system as described in any one of the first to fifth aspects, the controller controls a hydrogen supply amount by the hydrogen supply device to adjust an $H_2/CO$ ratio of synthesis gas flowing to the synthesis gas discharge area.

A fuel production method for producing a liquid fuel from a biomass raw material according to a seventh aspect of the present invention includes: a synthesis gas generating step of gasifying the biomass raw material and generating a synthesis gas containing hydrogen and carbon monoxide in a gasification furnace; a liquid fuel producing step of producing the liquid fuel from the synthesis gas generated in the synthesis gas generating step; a hydrogen supplying step of supplying hydrogen to a raw material supply area including inside of the gasification furnace and inside a raw material supply path of the biomass raw material leading to the gasification furnace, or to a synthesis gas discharge area at which the synthesis gas is discharged from the gasification furnace; a byproduct detecting step of detecting a byproduct amount generated in the synthesis gas generating step; and a switching step of switching a hydrogen supply location by the hydrogen supplying step between the raw material supply area and the synthesis gas discharge area, based on the byproduct amount detected in the byproduct detecting step.

According to the present invention, it is possible to efficiently perform adjustment of the synthesis gas composition by hydrogen supply, while suppressing the generated amount of carbon dioxide by the system overall.

DETAILED DESCRIPTION OF THE INVENTION

Hereinafter, a fuel production system 1 according to an embodiment of the present invention will be explained while referencing the drawings.

Figure 1:
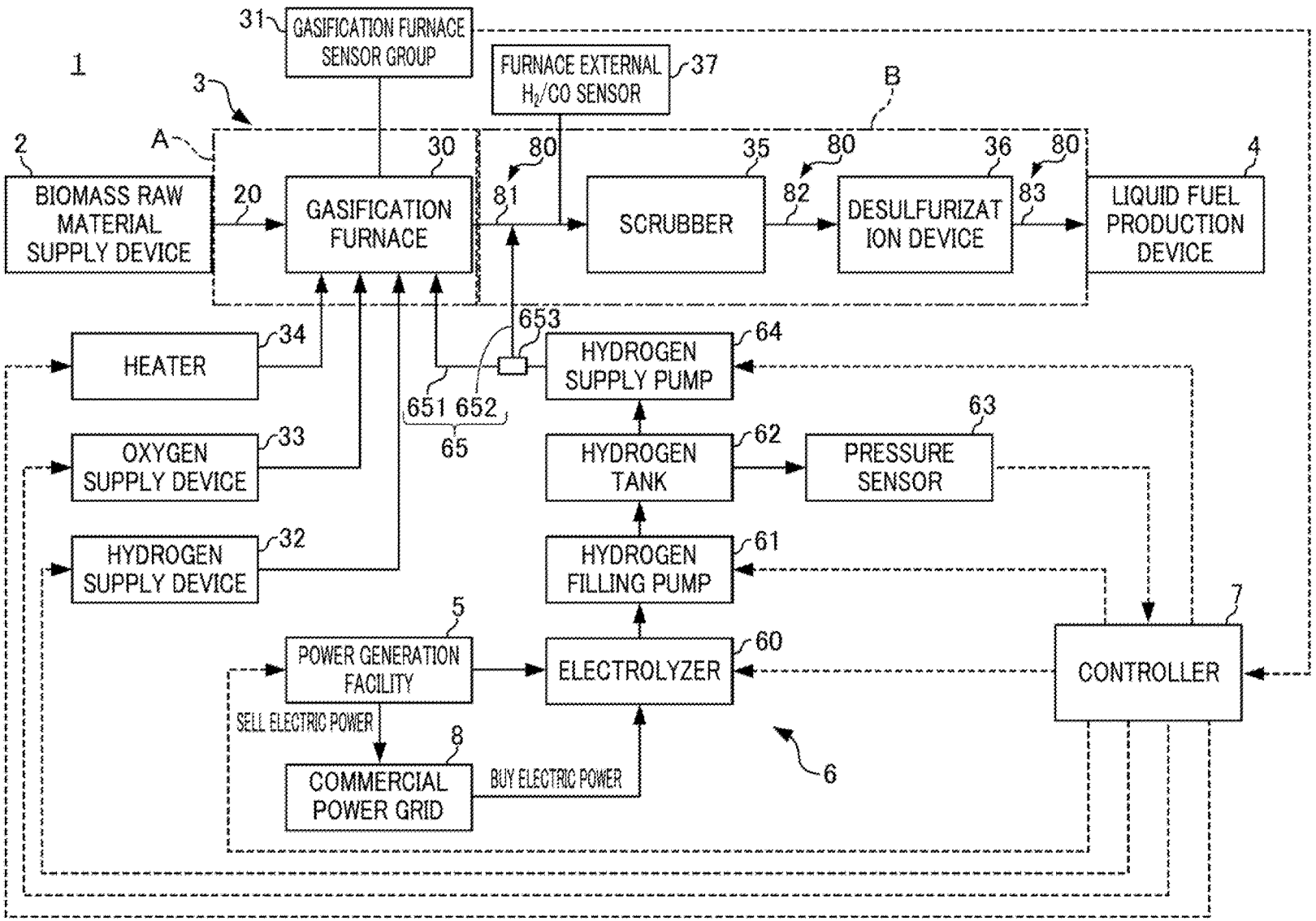
FIG. 1 is a view showing the configuration of a fuel production system according to an embodiment of the present invention.
Figure 2:
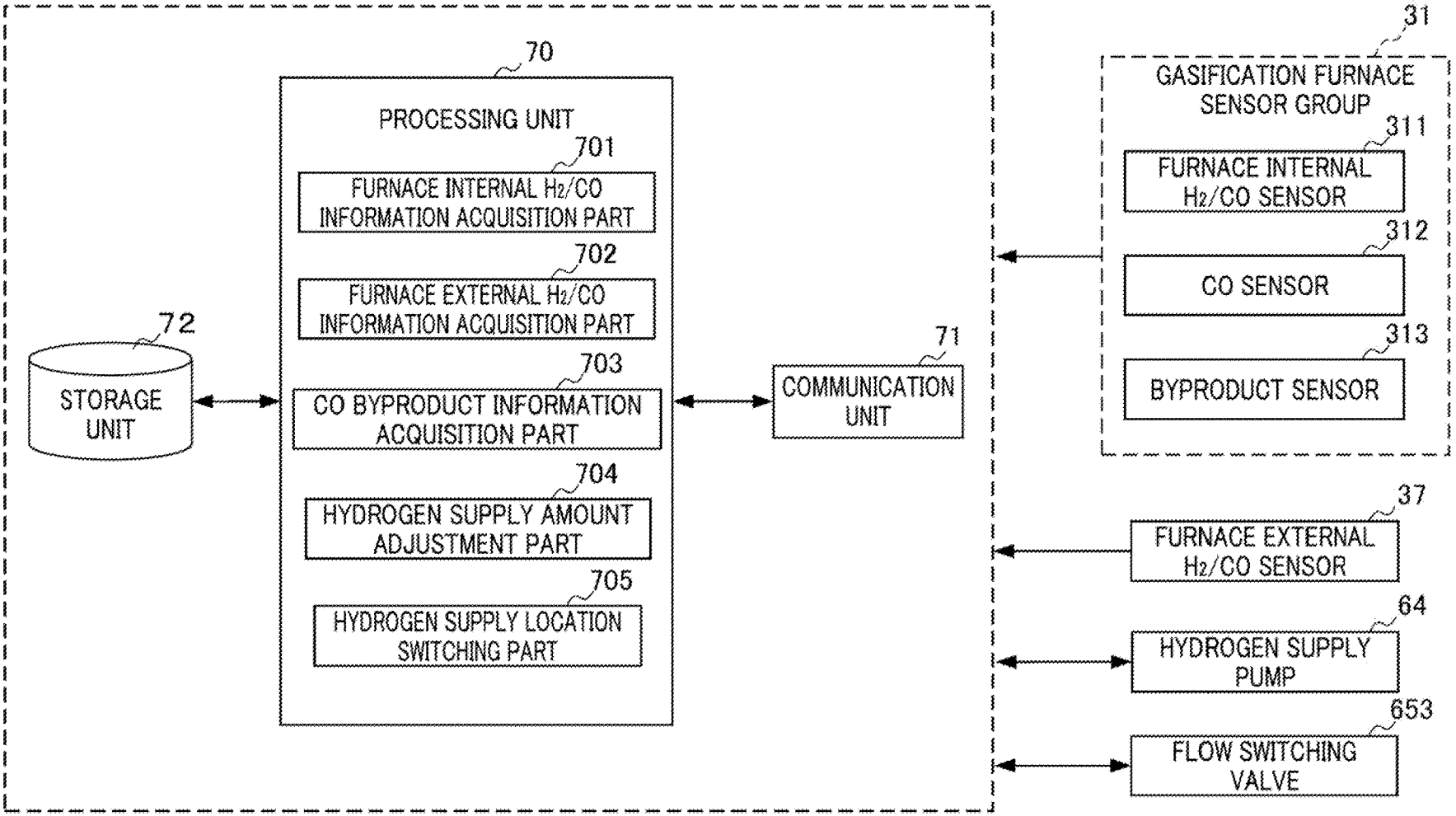
FIG. 2 is a functional block diagram of a controller of the fuel production system according to an embodiment of the present invention.

FIG. 1 is a view showing the configuration of the fuel production system 1 according to the present embodiment. FIG. 2 is a functional block diagram of a controller 7 of the fuel production system 1 according to the present embodiment. The fuel production system 1 includes: a biomass raw material supply device 2 that supplies biomass raw material; a gasifier 3 that generates synthesis gas containing hydrogen and carbon monoxide produced by gasifying the biomass raw material supplied from the biomass raw material supply device 2; a liquid fuel production device 4 that produces a liquid fuel from the synthesis gas supplied from the gasifier 3; a power generating facility 5 that generates power using a renewable energy; a hydrogen generation supply device 6 that generates hydrogen from water by way of the electric power generated in the power generating facility 5, and supplies the generated hydrogen to the gasifier 3; and a controller 7 that controls the gasifier 3, power generating facility 5 and hydrogen generation supply device 6, and produces a liquid fuel from biomass raw material using these.

The biomass raw material supply device 2 conducts a predetermined pretreatment on the biomass raw material such as rice husk, bagasse and wood, and supplies the biomass raw material subjected to this pretreatment to a gasification furnace 30 of the gasifier 3 via a raw material supply path 20. Herein, a drying step of drying the raw material, pulverization step of pulverizing the raw material, etc. are included in the pretreatment on the biomass raw material. It should be noted that the present disclosure refers to the inside of the gasification furnace 30 and inside the raw material supply path 20 as a raw material supply area A.

The gasifier 3 includes: the gasification furnace 30 which gasifies the biomass raw material supplied via the raw material supply path 20; a gasification furnace sensor group 31 configured by a plurality of sensors detecting the state inside the gasification furnace 30; a water supply device 32 that supplies water into the gasification furnace 30; an oxygen supply device 33 that supplies oxygen into the gasification furnace 30; a heater 34 that heats the gasification furnace 30; a scrubber 35 that scrubs the synthesis gas discharged from the gasification furnace 30; a desulfurization device 36 that removes sulfur components from the synthesis gas scrubbed by the scrubber 35, and supplies to the liquid fuel production device 4; and an furnace external $H_2/CO$ sensor 37. The synthesis gas discharged from the gasification furnace 30 is supplied to the liquid fuel production device 40 via a synthesis gas flow passage 80. The synthesis gas flow passage 80 includes a first synthesis gas flow passage 81 communicating the gasification furnace 30 and scrubber 35; a second synthesis gas flow passage 82 communicating the scrubber 35 and desulfurization device 36; and a third synthesis gas flow passage 83 communicating the desulfurization device 36 and liquid fuel production device 40. It should be noted that, in the present disclosure, a region including the inside of the first synthesis gas flow passage 81, inside of the scrubber 35, inside of the second synthesis gas flow passage 82, inside of desulfurization device 36, and inside of the third synthesis gas flow passage 83, i.e. a region in which synthesis gas is discharged from the gasification furnace 30, is referred to as synthesis gas discharge region B.

The water supply device 32 supplies water stored in a water tank (not shown) into the gasification furnace 30. The oxygen supply device 33 supplies the oxygen stored in an oxygen tank (not shown) into the gasification furnace 30. The heater 34 heats the gasification furnace 30, by consuming fuel supplied from a fuel tank (not shown) and/or electric power supplied from a power supply (not shown). The water supply amount from the water supply device 32 to the gasification furnace 30, oxygen supply amount from the oxygen supply device 33 into the gasification furnace 30, and input heat quantity from the heater 34 to the gasification furnace 30 are controlled by the controller 7. It should be noted that, in the fuel production system 1 according to the present embodiment, there are cases where it is not necessary to actively supply water from the water supply device 32 to the gasification furnace 30, by supplying hydrogen from the hydrogen generation supply device 6 described later to the raw material supply area A.

If charging water, oxygen, hydrogen, heat, etc. by the above such water supply device 32, oxygen supply device 33, heater 34 and hydrogen generation supply device 6 into the gasification furnace 30 to which the biomass raw material was charged, a plurality of types of gasification reactions and the reverse reaction thereto as shown in the below Formulas (1-1) to (1-8) progress within the gasification furnace 30, and synthesis gas containing hydrogen, carbon monoxide, carbon dioxide, and byproducts such as methane is generated.

[Chem. 1]

$$C+O_2 \leftrightarrows CO_2 \quad (1\text{-}1)$$

$$C+1/2O_2 \leftrightarrows CO \quad (1\text{-}2)$$

$$C+CO_2 \leftrightarrows 2CO \quad (1\text{-}3)$$

$$CO+1/2O_2 \leftrightarrows CO_2 \quad (1\text{-}4)$$

$$C+H_2O \leftrightarrows CO+H_2 \quad (1\text{-}5)$$

$$CO+H_2O \leftrightarrows CO_2+H_2 \quad (1\text{-}6)$$

$$CO+3H_2 \leftrightarrows CH_4+H_2O \quad (1\text{-}7)$$

$$CO_2+4H_2 \leftrightarrows CH_4+2H_2O \quad (1\text{-}8)$$

The gasification furnace sensor group 31, for example, is configured by a pressure sensor 63 that detects the pressure inside of the gasification furnace 30; a temperature sensor that detects the temperature inside the gasification furnace 30; a $CO_2$ sensor that detects the carbon dioxide inside the gasification furnace 30; a CO sensor 312 that detects the carbon monoxide inside the gasification furnace 30; an furnace internal $H_2$/CO sensor 311 that detects a $H_2$/CO ratio corresponding to the ratio of hydrogen to carbon monoxide in the synthesis gas inside the gasification furnace 30; a byproduct sensor 313 as a byproduct detector that detects the byproduct amount generated inside the gasification furnace 30; etc. The CO sensor 312 is configured by a constant potential electrolytic sensor or the like that detects carbon monoxide within the gasification furnace 30, for example. In addition, the byproduct sensor 313, for example, is configured to include a low voltage electrolytic sensor that detects methane amount, a liquid flow sensor or the like that detects tar amount by detecting the liquid amount in a tar trap, and the like. The detection signals of these sensors constituting the gasification furnace sensor group 31 are sent to the controller 7.

The furnace external $H_2$/CO sensor 37 is provided within the synthesis gas discharge area B, and detects a synthesis gas $H_2$/CO ratio flowing in the synthesis gas discharge area B. The furnace external $H_2$/CO sensor 37 is provided to at least any of inside the first synthesis gas flow passage 81, inside the second synthesis gas flow passage 82 and inside the third synthesis gas flow passage 83, and detects the $H_2$/CO ratio of synthesis gas flowing within the synthesis gas flow passage 80. In the present embodiment, the furnace external $H_2$/CO sensor 37 is provided within the first synthesis gas flow passage 81; however, it may be provided within the second synthesis gas flow passage 82, or may be provided within the third synthesis gas flow passage 83.

The gasifier 3 adjusts the $H_2$/CO ratio of synthesis gas to a predetermined target value according to the liquid fuel sought to be produced, by mixing hydrogen supplied from the hydrogen generation supply device 6 described later, to the synthesis gas generated by the gasification reaction and reverse reaction thereto shown in the above Formulas (1-1) to (1-8), and then supplies this synthesis gas to the liquid fuel production device 4.

The liquid fuel production device 4 includes a methanol synthesis device, MTG (Methanol To Gasoline) synthesis device, FT (Fischer Tropsch) synthesis device, upgrading device, etc., and produces a liquid fuel such as methanol and gasoline from the synthesis gas adjusted to a predetermined $H_2$/CO ratio in the gasifier 3, using these.

The power generating facility 5 is configured by a wind power plant which generates power from wind power, which is a renewable energy, a solar power plant which generates power by sunlight, which is a renewable energy, or the like. The power generating facility 5 is connected to the hydrogen generation supply device 6, and can supply electric power generated using a renewable energy in the wind power plant, solar power plant, etc. to the hydrogen generation supply device 6. In addition, the power generating facility 5 is also connected with a commercial power grid 8. For this reason, a part or all of the electric power generated in the power generating facility 5 can be supplied to the commercial power grid 8, and can be sold to the power company.

The hydrogen generation supply device 6 includes an electrolyzer 60, hydrogen filling pump 61, hydrogen tank 62, pressure sensor 63, and a hydrogen supply pump 64 as a hydrogen supply device, generates hydrogen from the electric power supplied from the power generating facility 5 using these, and supplies the generated hydrogen to the gasifier 3.

The electrolyzer 60 is connected with the power generating facility 5, and generates hydrogen by electrolysis from water by way of the electric power supplied from the power generation facility 5. In addition, the electrolyzer 60 is connected with the commercial power grid 8. For this reason, the electrolyzer 60 becomes able to generate hydrogen not only by the electric power supplied from the power generating facility 5, but also electric power supplied from the commercial power grid 8 by purchasing from a power company. The hydrogen generation amount by the electrolyzer 60 is controlled by the controller 7.

The hydrogen filling pump 61 compresses hydrogen generated by the electrolyzer 60, and fills into the hydrogen tank 62. The hydrogen filling amount of the hydrogen filling pump 61 is controlled by the controller 7. The hydrogen tank 62 stores the hydrogen compressed by the hydrogen filling pump 61. The pressure sensor 63 detects the tank internal pressure of the hydrogen tank 62, and sends the detection signal to the controller 7. The hydrogen residual amount of the hydrogen tank 62 is calculated by the controller 7 based on the detection signal of the pressure sensor 63. Therefore, in the present embodiment, a hydrogen residual amount acquisition means for acquiring the hydrogen residual amount in the hydrogen tank 62 is configured by the pressure sensor 63 and the controller 7.

The hydrogen supply pump 64 supplies the hydrogen stored in the hydrogen tank 62 to the gasifier 3. The hydrogen supply pump 64 supplies the hydrogen stored in the hydrogen tank 62 via the hydrogen supply path 65 to the raw material supply area A or synthesis gas discharge area B. The hydrogen supply location by the hydrogen supply pump 64 of the raw material supply area A may be inside the raw material supply path 20, or may be inside the gasification furnace 30, for example. In the present embodiment, the hydrogen supply location of the raw material supply area A is inside the gasification furnace 30. The hydrogen supply location by the hydrogen supply pump 64 of the synthesis gas discharge area B, for example, may be inside the first synthesis gas flow passage 81, may be inside the second synthesis gas flow passage 82, may be inside the third synthesis gas flow passage 83, may be inside the scrubber 35, or may be inside the desulfurization device 36. In the present embodiment, the hydrogen supply location of the synthesis gas discharge area B is inside the first synthesis gas flow passage 81.

The hydrogen supply path 65 includes a first hydrogen supply path 651 which connects between the hydrogen supply pump 64 and gasification furnace 30 to be able to flow hydrogen; and a second hydrogen supply path 652 branches from the first hydrogen supply path 651 via a flow switching valve 653, and is connected to the first synthesis gas flow passage 81 through which hydrogen can flow. The flow switching valve 653 is a device which performs opening/closing or switching of a flow path, by controlling the opening/closing state of a plurality of values provided inside. In other words, the hydrogen supply location from the hydrogen supply pump 64 is switched between inside the gasification furnace 30 and inside the first synthesis gas flow passage 81, by controlling the opening/closing operation of valves of the flow switching valve 653.

The controller 7 is a computer which controls a hydrogen supply amount from the hydrogen supply device 32, oxygen supply amount from the oxygen supply device 33, input heat amount by the heater 34, hydrogen generation amount by the electrolyzer 60, and hydrogen filling amount by the hydrogen filling pump 61, based on detection signals, etc. from various sensors such as the gasification furnace sensor group 31 and pressure sensor 63. In addition, based on the detection signals, etc. from various sensors from the gasification furnace sensor group 31 and/or furnace external $H_2$/CO sensor 37, the controller 7 controls the hydrogen supply amount from the hydrogen supply pump 64 to the gasifier 3, and executes hydrogen supply processing of switching the hydrogen supply location of the gasifier 3 from the hydrogen supply pump 64. The hydrogen supply processing executed by the controller 7 is described later.

Next, the influence on the gasification rate, gas composition in the gasification furnace 30, etc. when supplying hydrogen into the gasification furnace 30 will be explained.

First, the influence on the gasification rate in the gasification furnace 30 by hydrogen supply will be explained while referencing FIG. 3 and FIG. 4.

Figure 3:
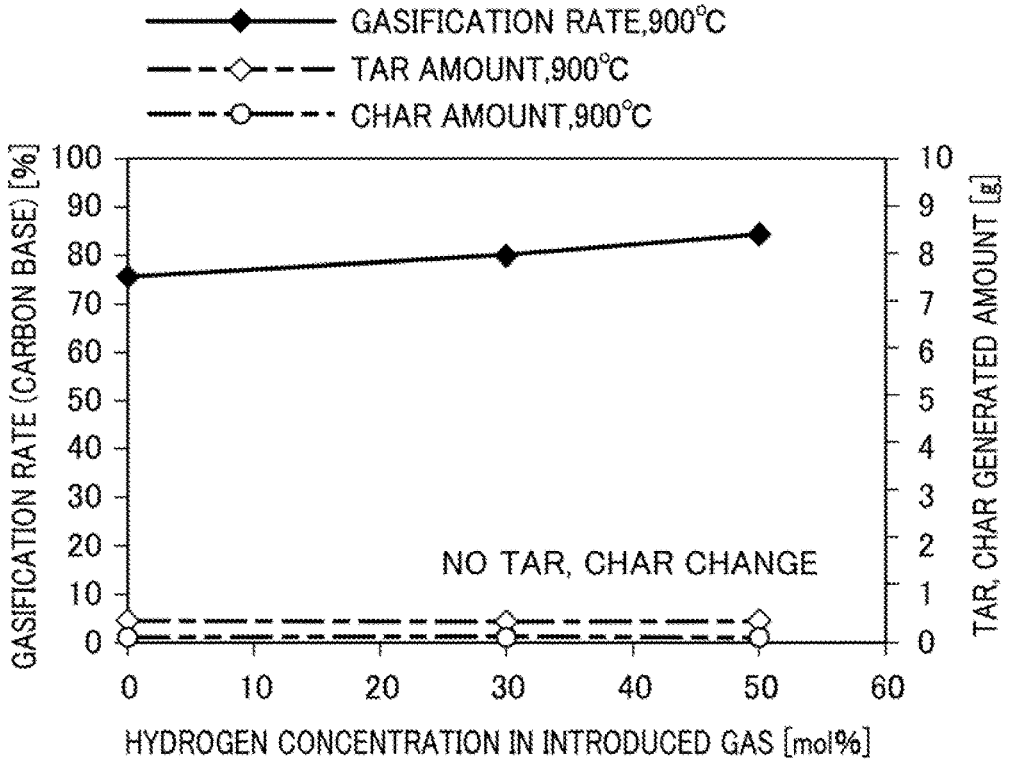
FIG. 3 is a graph showing the relationships between hydrogen concentration in introduced gas supplied to a gasification furnace at 900° C., and the gasification rate in a gasification furnace, and generated amounts of tar and char.
Figure 4:
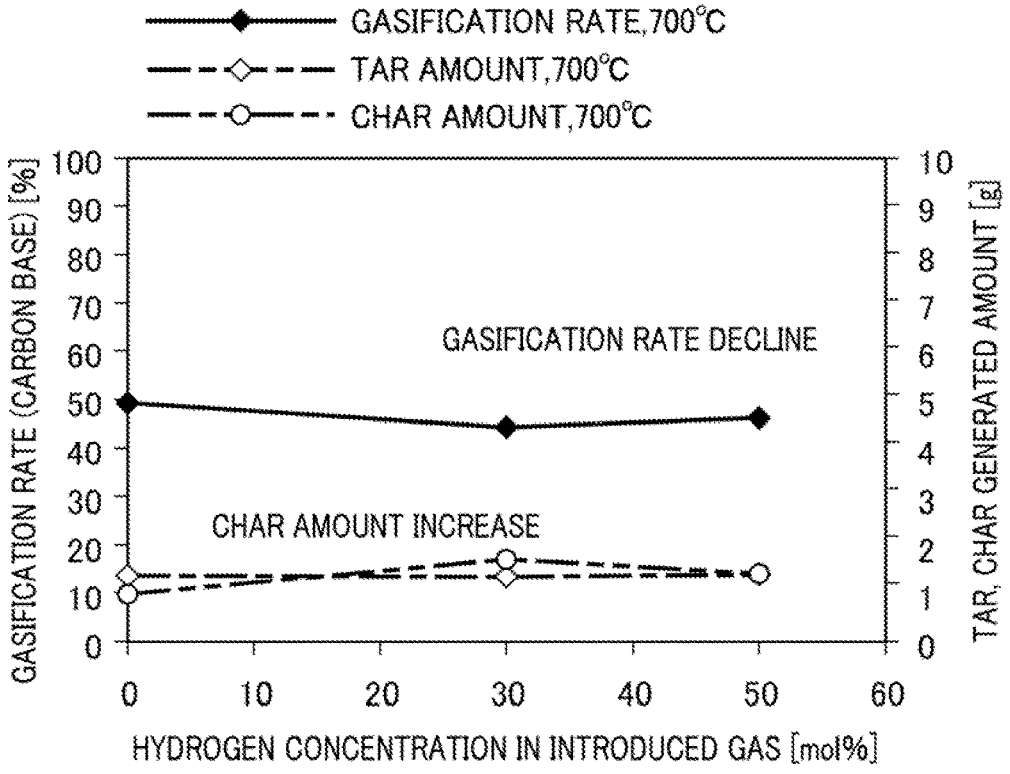
FIG. 4 is a graph showing the relationships between hydrogen concentration in introduced gas supplied to a gasification furnace at 700° C., and the gasification rate in a gasification furnace, and generated amounts of tar and char.

FIG. 3 and FIG. 4 are graphs showing the relationships between hydrogen concentration (mol %) in the introduced gas supplied to the gasification furnace 30, gasification rate (%) calculated on carbon basis in the gasification furnace 30, and generated amounts (g) of tar and char, which are byproducts. The solid lines in FIG. 3 and FIG. 4 indicate the gasification rate according to the hydrogen supply, the one-dot chain lines indicate the generated amount of tar, and the two-dot chain lines indicate the generated amount of char. The results shown in FIG. 3 are obtained by performing simulation under conditions of temperature within the gasification furnace 30 of 900° C. and S/C of 3. The results shown in FIG. 4 are obtained by performing simulation under conditions of temperature within the gasification furnace 30 of 700° C. and S/C of 3. On the other hand, there are cases of the gasification rate of the gasification furnace 30 according to hydrogen supply declining due to the operating conditions of the gasification furnace 30.

As shown in FIG. 4, in the case of the temperature in the gasification furnace 30 being 700° C., the gasification rate declines, and the char amount and tar amount increase, as the hydrogen concentration in the introduced gas becomes larger. On the other hand, as shown in FIG. 3, in the case of the temperature in the gasification furnace 30 being 900° C., the high gasification rate is obtained, and do not produce a change in generated amounts of char and tar, irrespective of the hydrogen concentration in the introduced gas. This is because inside the gasification furnace 30 is high temperature, and gasification sufficiently progresses; therefore, the influence on gasification suppression by hydrogen supply is curbed to be small. From the results shown in FIG. 3 and FIG. 4, the influence from hydrogen supply can be confirmed to differ according to the operating conditions of the gasification furnace 30. In addition, it is possible to confirm that the gasification rate of the gasification furnace 30 may decline by the hydrogen supply, according to the operating conditions of the gasification furnace 30.

Next, the influence on gas composition of the synthesis gas by hydrogen supply will be explained while referencing FIG. 5 and FIG. 6.

Figure 5:
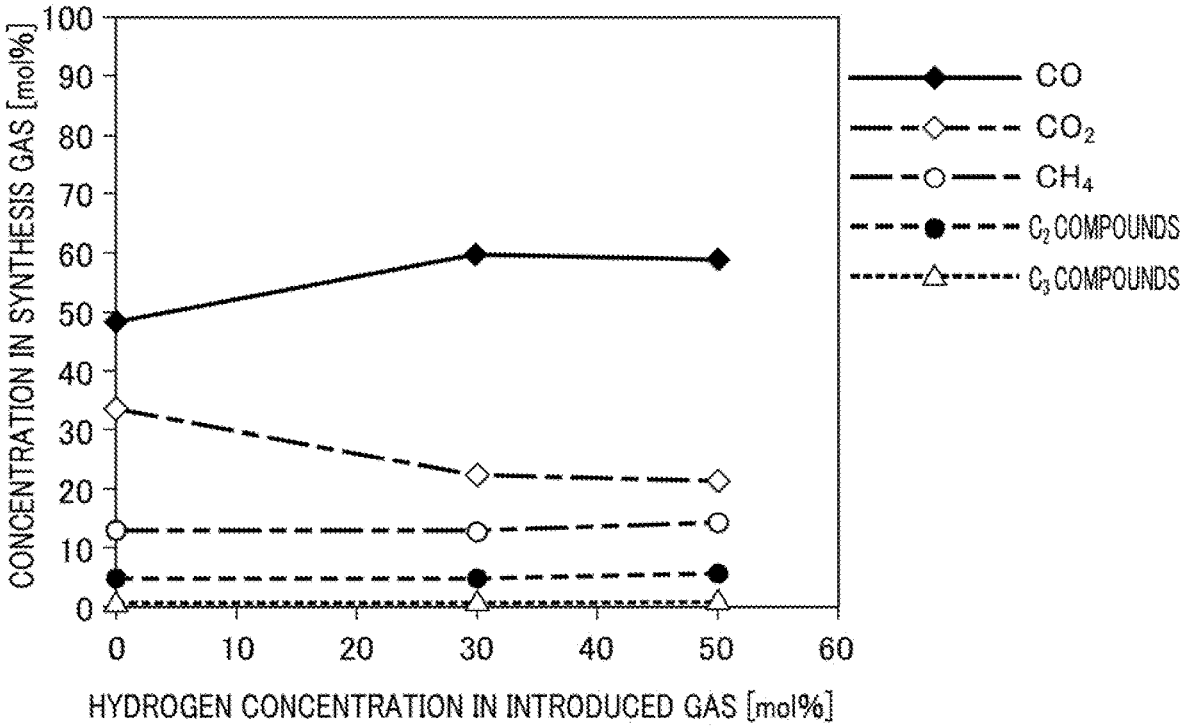
FIG. 5 is a graph showing the relationships between hydrogen concentration in introduced gas supplied to a gasification furnace, and the concentrations of various gases in the synthesis gas generated by the gasification furnace.

FIG. 5 is a graph showing a relationship between hydrogen concentration (mol %) in the introduced gas supplied to the gasification furnace 30, and concentration (mol %) of various gases in the synthesis gas generated by the gasification furnace 30. The solid line in FIG. 5 indicates the concentration of carbon monoxide in the synthesis gas, the one-dot chain line indicates the concentration of carbon dioxide in the synthesis gas, the two-dot chain line indicates the concentration of methane in the synthesis, the long dashed line indicates the concentration of $C_2$ compounds in the synthesis gas, and the short dashed line indicates the concentration of $C_3$ compounds in the synthesis gas. FIG. 6 is a graph showing the relationship between the hydrogen concentration (mol %) in the introduced gas supplied to the gasification furnace 30, and the amounts (mol) of various gases generated by the gasification furnace 30. The results shown in FIG. 5 and FIG. 6 are obtained by performing simulation under conditions of temperature within the gasification furnace 30 of 900° C. and S/C of 3.

Figure 6:
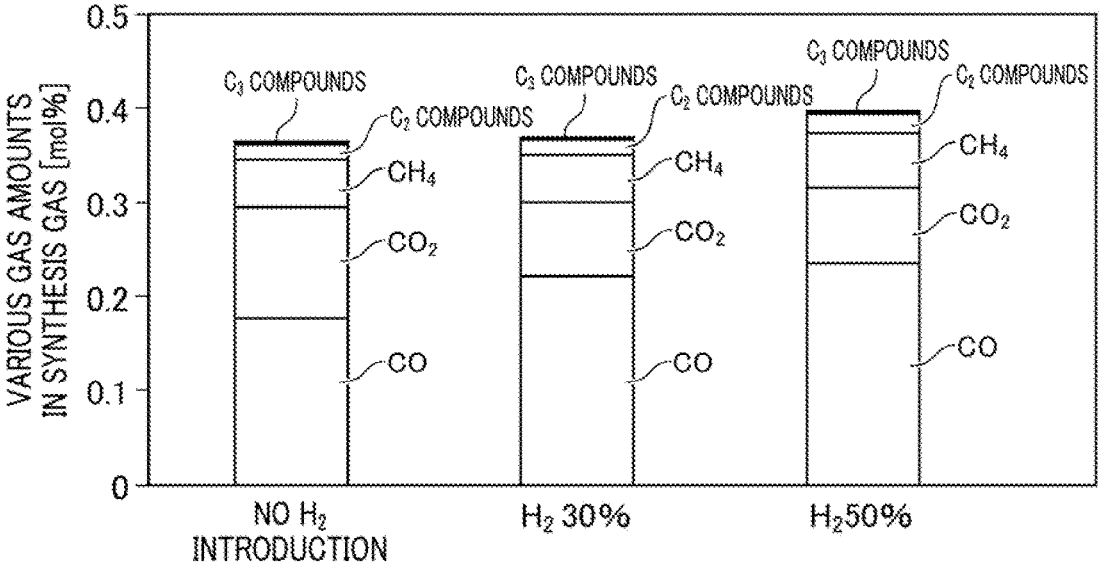
FIG. 6 is a graph showing the relationships of hydrogen concentration in introduced gas supplied to a gasification furnace, and amounts of various gases generated by the gasification furnace.

As shown in FIG. 5 and FIG. 6, it is possible to confirm that the carbon dioxide amount decreases by the hydrogen supply to the gasification furnace 30, and the carbon monoxide amount increases in the same amount as the decreased amount of carbon dioxide. This can be considered to be due to the chemical reaction shown in the above Formula (1-6). In the chemical reaction shown in the above Formula (1-6), the reverse water gas shift reaction proceeds spontaneously, in the case of the temperature in the gasification furnace 30 being a high temperature such as 900° C., for example.

According to this reverse water gas shift reaction, when supplying hydrogen into the gasification furnace 30, the carbon dioxide decreases, and the carbon monoxide increases in the same amount as the decreased amount of carbon dioxide. It is thereby possible to suppress the generated amount of carbon dioxide in the gasification furnace 30.

On the other hand, as shown in FIG. 5 and FIG. 6, it could be confirmed that the decreased amount of carbon dioxide and increased amount of carbon monoxide became smaller as the hydrogen concentration in the introduced gas supplied to the gasification furnace 30 increases. In contrast, it could be confirmed that the generated amount of methane which is a byproduct increases in a fixed proportion irrespective of the hydrogen concentration supplied to the gasification furnace 30. In other words, if becoming at least a certain hydrogen supply amount, the increased amount of carbon monoxide declines; whereas, the proportion of supplied hydrogen being consumed in the generation of byproducts can be considered to increase.

As shown in FIG. 5 and FIG. 6, when the increasing effect of carbon monoxide becomes smaller, the proportion consumed in the generation of byproducts increases even if adding and introducing hydrogen, and hydrogen is wastefully consumed. In contrast, the present embodiment performs hydrogen supply processing of switching, with the object of an improvement in the production efficiency of fuel by hydrogen supply, the hydrogen supply location from the raw material supply area A to the synthesis gas discharge area B which is on the downstream side of the gasification furnace 30, and where the reaction generating the byproduct does not occur, based on the byproduct amount in the gasification furnace 30, etc.

Next, the configuration of hardware of the controller 7 executing the hydrogen supply processing will be explained. As shown in FIG. 2, the controller 7 includes a communication unit 71, storage unit 72, and processing unit 70.

The communication unit 71 controls communication performed with other devices such as the gasification furnace sensor group 31, furnace external $H_2$/CO sensor 37, electrolyzer 60, hydrogen supply pump 64, and flow switching valve 653. The communication unit 71 sends and receives detection signals, controls signals, etc. with these devices.

The storage unit 72 is a storage area of various programs for making a hardware group to function as the controller 7, various data, etc., and can be configured by ROM, RAM, flash memory, semiconductor drive (SSD) or hardware (HDD). More specifically, the storage unit 72 stores programs for causing each function of the present embodiment to execute in the processing unit 70, a control program of hydrogen supply processing, target values of $H_2$/CO ratio which is appropriate according to the type of liquid fuel to be produced and production device thereof, first switching determination value or second switching determination value described later, etc.

The processing unit 70 is an arithmetic unit configured by a processor, and reads out various programs and data from the storage unit 72 and executes predetermined data processing. The processor, for example, is a CPU (central processing unit), MPU (micro processing unit), SoC (system on a chip), DSP (digital signal processor), GPU (graphics processing unit), VPU (vision processing unit), ASIC (application specific integrated circuit), PLD (programmable logic device), FPGA (field-programmable gate array), or the like.

Next, the functional configuration of the processing unit 70 of the controller 7 for executing hydrogen supply processing in the fuel production system 1 will be explained while referencing FIG. 1 and FIG. 2. As shown in FIG. 2, the processing unit 70 includes a furnace internal $H_2$/CO information acquisition part 701, a furnace external $H_2$/CO information acquisition part 702, a CO byproduct information acquisition part 703, a hydrogen supply amount adjustment part 704 and a hydrogen supply location switching part 705.

The furnace internal $H_2$/CO information acquisition part 701 executes processing of acquiring the furnace internal $H_2$/CO information indicating the $H_2$/CO ratio in the gasification furnace 30 detected by the furnace internal $H_2$/CO sensor 311. The furnace internal $H_2$/CO information acquisition part 701 acquires the furnace internal $H_2$/CO information by receiving a detection signal from the furnace internal $H_2$/CO sensor 311 via the communication unit 71.

The furnace external $H_2$/CO information acquisition part 702 executes processing of acquiring the furnace external $H_2$/CO information indicating the $H_2$/CO ratio in the synthesis gas inside the synthesis gas discharge area B detected by the furnace external $H_2$/CO sensor 37. The furnace external $H_2$/CO information acquisition part 702 acquires the furnace external $H_2$/CO information by receiving the detection signal from the furnace external $H_2$/CO sensor 37 via the communication unit 71.

The CO byproduct information acquisition part 703 executes processing of acquiring CO information indicating the CO amount in the gasification furnace 30 detected by the CO sensor 312, and the byproduct information indicating the byproduct amount in the gasification furnace 30 detected by the byproduct sensor 313. The CO byproduct information acquisition part 703 acquires CO information by receiving the detection signal from the CO sensor 312 via the communication unit 71, and acquires the byproduct information by receiving the detect signal from the byproduct sensor 313.

The hydrogen supply amount adjustment part 704 executes processing of adjusting the hydrogen supply amount supplied to the gasifier 3 by controlling the driving of the hydrogen supply pump 64. The hydrogen supply amount adjustment part 704 executes processing of stopping the supply of hydrogen or varying the hydrogen supply amount to the gasifier 3, based on the furnace internal $H_2$/CO information and furnace external $H_2$/CO information. The hydrogen supply amount adjustment part 704, for example, may increase the hydrogen supply amount in the case of the $H_2$/CO ratio being less than a predetermined target value, or may stop the supply of hydrogen in the case of the $H_2$/CO ratio exceeding the predetermined target value. The target value for the $H_2$/CO ratio in the synthesis gas may be set to a suitable value according to the type of liquid fuel to be produced and the production device thereof. For example, in the case of producing liquid fuel by FT synthesis or methanol synthesis, the target value for the $H_2$/CO ratio in the synthesis gas may be set to 2.

The hydrogen supply location switching part 705 executes processing of switching the hydrogen supply location in the gasifier 3, by controlling the opening/closing operation of the flow switching valve 653. The hydrogen supply location switching part 705 switches the hydrogen supply location by the hydrogen supply pump 64 between the raw material supply area A and synthesis gas discharge area B, based on the byproduct information acquired by the CO byproduct information acquisition part 703. In the present embodiment, the hydrogen supply location switching part 705 switches the hydrogen supply location by the hydrogen supply pump 64 between inside the gasification furnace 30 and inside the first synthesis gas flow passage 81. For example, the hydrogen supply location switching part 705 may switch the hydrogen supply location from inside the gasification furnace 30 to inside the first synthesis gas flow passage 81, when the byproduct amount is at least a predetermined value. In addition, for example, the hydrogen supply location switching part 705 may switch the hydrogen supply location from inside the gasification furnace 30 to inside the first synthesis gas flow passage 81, when the byproduct amount per unit time is at least a predetermined value. In addition, for example, the hydrogen supply location switching part 705 may switch the hydrogen supply location from inside the gasification furnace 30 to inside the first synthesis gas flow passage 81, when a ratio of Δ CO/Δ byproduct, which is a ratio of the carbon monoxide amount per unit time relative to the byproduct amount per unit time, is no more than a predetermined value.

Figure 7:
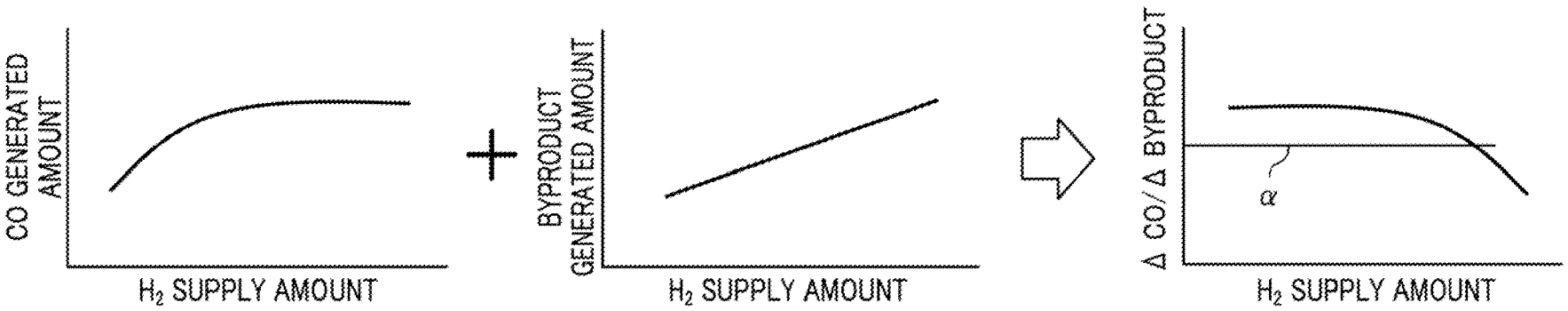
FIG. 7 is a graph schematically showing a generated amount of carbon monoxide, generated amount of byproducts relative to a hydrogen supply amount to the gasification furnace, and the ratio of $\Delta$ CO/$\Delta$ byproduct.

FIG. 7 is a graph schematically showing the generated amount of carbon monoxide, generated amount of byproduct, and ratio of Δ CO/Δ byproduct relative to the hydrogen supply amount to the gasification furnace 30. The graph on the left side of the paper plane in FIG. 7 shows the generated amount of carbon monoxide relative to the hydrogen supply amount to the gasification furnace 30, the graph at the central of the paper plane shows the generated amount of byproduct relative to the hydrogen supply amount to the gasification furnace 30, and the graph on the right side in the paper plane shows the ratio of Δ CO/Δ byproduct and a predetermined value serving as the basis for switching the hydrogen supply location, relative to the hydrogen supply amount to the gasification furnace 30. As shown in FIG. 7, the generated amount of byproduct relative to the hydrogen supply amount increases proportionally to the hydrogen supply amount; whereas, the generated amount of carbon monoxide reaches a constant when the hydrogen supply amount becomes large. In other words, when the hydrogen supply amount becomes large, the proportion of the synthesis gas generated by the gasification furnace 30 occupied by the byproduct is large, and the proportion occupied by carbon monoxide is small. As shown in the graph on the right side of FIG. 7, it is possible to switch the hydrogen supply location at a more appropriate timing, by employing the ratio of Δ CO/Δ byproduct.

Figure 8:
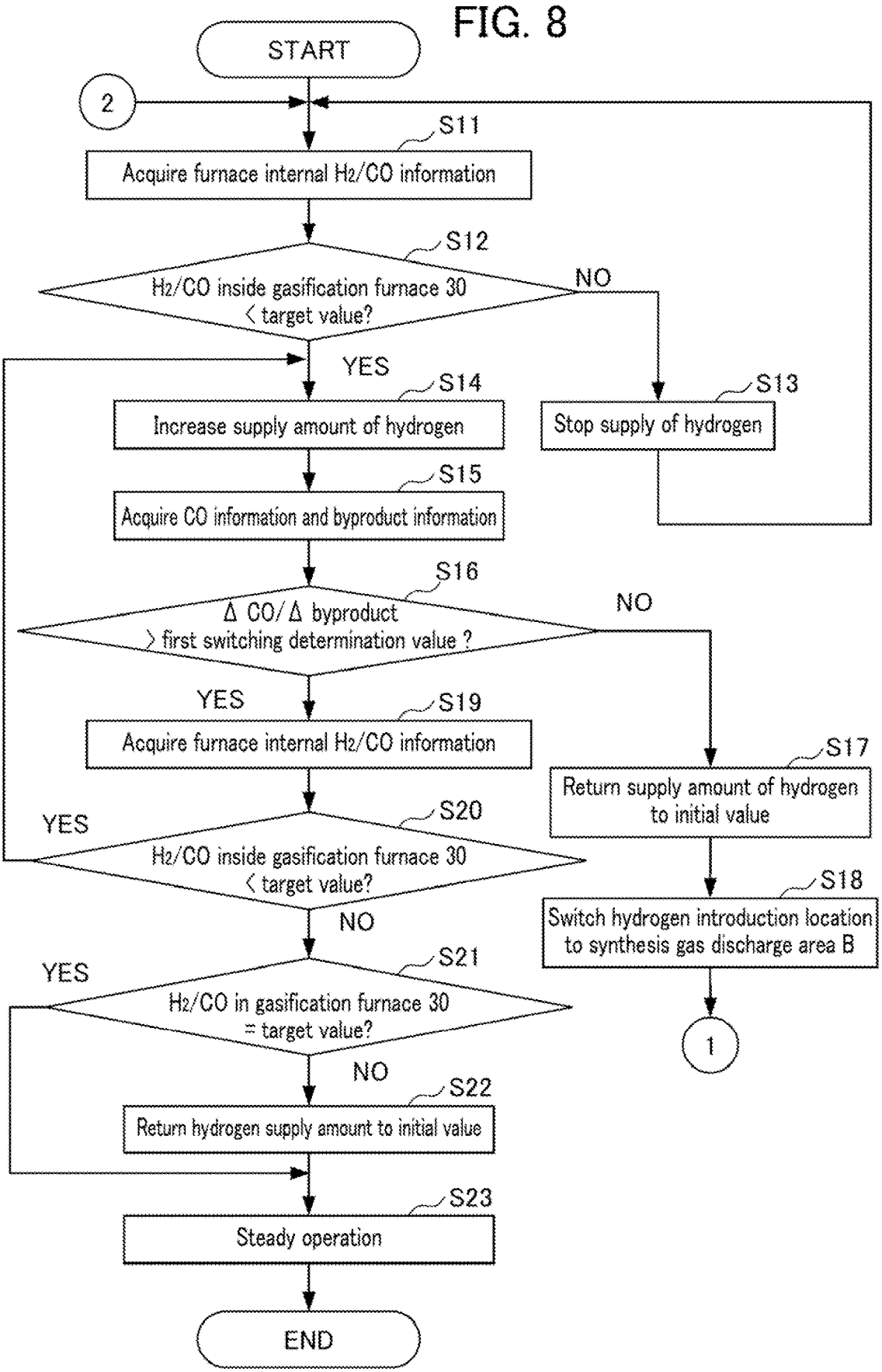
FIG. 8 is a flowchart showing an example of the flow of processing in a case of a hydrogen supply location in hydrogen supply processing executed by a controller of a fuel production system according to an embodiment of the present invention being a raw material supply area.
Figure 9:
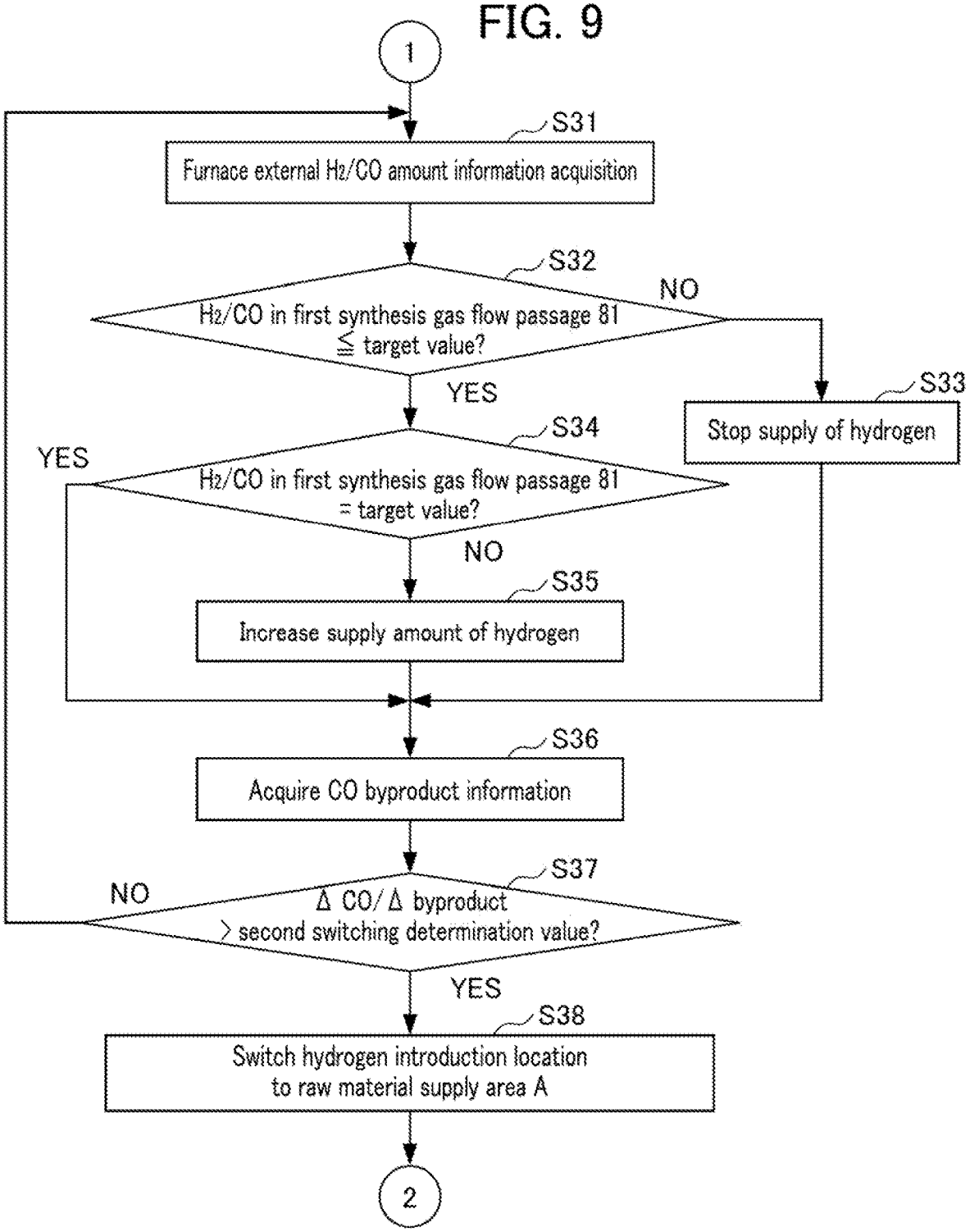
FIG. 9 is a flowchart showing an example of the flow of processing in a case of a hydrogen supply location in hydrogen supply processing executed by a controller of a fuel production system according to an embodiment of the present invention being a synthesis gas discharge area.

Next, an example of hydrogen supply processing executed by the processing unit 70 of the controller 7 will be explained while referencing FIG. 8 and FIG. 9. FIG. 8 is flowchart showing an example of the flow of processing in the case of the hydrogen supply location being the raw material supply area A, in the hydrogen supply processing executed by the processing unit 70 of the controller 7 in the fuel supply system 1. FIG. 9 is a flowchart showing an example of the flow of processing in the case of the hydrogen supply location being the synthesis gas discharge area B, in the hydrogen supply processing executed by the processing unit 70 of the controller 7 in the fuel supply system 1. The hydrogen supply processing is started at a timing at which the fuel supply system 1 including the controller 7 is activated, and starting the production of liquid fuel. It should be noted that, during the start of the hydrogen supply processing, the hydrogen supply location by the hydrogen supply pump 64 is set to inside the gasification furnace 30, and the hydrogen supply amount is set to a predetermined initial value.

As shown in FIG. 8, in Step S11, the furnace internal $H_2$/CO information acquisition part 701 acquires the furnace internal $H_2$/CO information indicating the $H_2$/CO ratio inside the gasification furnace 30 detected by the furnace internal $H_2$/CO sensor 311.

In Step S12, the hydrogen supply amount adjustment part 704 determines whether or not the $H_2$/CO ratio inside the gasification furnace 30 is less than a predetermined value, by comparing the furnace internal $H_2$/CO information acquired in Step S11 and the target value extracted from the storage unit 72. The hydrogen supply amount adjustment part 704 advances the processing to Step S13, in the case of determining that the $H_2$/CO ratio inside the gasification furnace 30 is at least the target value (NO in Step S12). Then, the hydrogen supply amount adjustment part 704 stops the supply of hydrogen from the hydrogen supply pump 64 to the gasification furnace 30 in Step S13, and then returns the processing to Step S11. On the other hand, the hydrogen supply amount adjustment part 704 advances the processing to Step S14, in the case of determining that the $H_2$/CO ratio inside the gasification furnace 30 is less than the target value (YES in Step S12).

In Step S14, the hydrogen supply amount adjustment part 704 increases the hydrogen supply amount from the hydrogen supply pump 64 to the gasification furnace 30.

In Step S15, the CO byproduct information acquisition part 703 acquires CO information indicating the CO amount inside the gasification furnace 30, and byproduct information indicating the byproduct amount inside the gasification furnace 30.

In Step S16, the hydrogen supply location switching part 705 obtains the ratio of Δ CO/Δ byproduct from the CO information and byproduct information acquired in Step S15, and determines whether this ratio of Δ CO/Δ byproduct is larger than a first switching determination value that is a predetermined value. The hydrogen supply location switching part 705 advances the processing to Step S17, in the case of determining that the ratio of Δ CO/Δ byproduct is no more than the first switching determination value (NO in Step S16). Then, in Step S17, the hydrogen supply amount adjustment part 704 returns the hydrogen supply amount to the initial value, and advances the processing to Step S18. In Step S18, the hydrogen supply location switching part 705 controls the opening/closing operation of the flow switching valve 653, and switches the hydrogen supply location by the hydrogen supply pump 64 from the gasification furnace 30 to the first synthesis gas flow passage 81 which is more to the downstream side than the gasification furnace 30. The flow of processing in the case of the hydrogen supply location being the first synthesis gas flow passage 81 will be described later. On the other hand, the hydrogen supply location switching part 705 advances the processing to Step S19, in the case of determining that the ratio of Δ CO/Δ byproduct exceeds the first switching determination value (YES in Step S16).

In Step S19, the furnace internal $H_2$/CO information acquisition part 701 acquires the furnace internal $H_2$/CO information.

In Step S20, the hydrogen supply amount adjustment part 704 determines whether the $H_2$/CO ratio inside the gasification furnace 30 is less than the target value, by comparing the furnace internal $H_2$/CO information acquired in Step S19 and the target value extracted from the storage unit 72. The hydrogen supply amount adjustment part 704 returns the processing to Step S14, in the case of determining that the $H_2$/CO ratio inside the gasification furnace 30 is less than the target value (YES in Step S20). On the other hand, the hydrogen supply amount adjustment part 704 advances the processing to Step S20, in the case of determining that the $H_2$/CO ratio inside the gasification furnace 30 is at least the target value (NO in Step S20).

In Step S21, the hydrogen supply amount adjustment part 704 determines whether the $H_2$/CO ratio inside the gasification furnace 30 equals the target value, by comparing the furnace internal $H_2$/CO information acquired in Step S19 and the target value extracted from the storage unit 72. The hydrogen supply amount adjustment part 704 advances the processing to Step S22, in the case of the $H_2$/CO ratio inside the gasification furnace 30 differing from the target value (NO in Step S21). Then, in Step S22, the hydrogen supply amount adjustment part 704 returns the hydrogen supply amount to the initial value, and then advances the processing to Step S23. On the other hand, the hydrogen supply amount adjusting part 704 advances the processing to Step S23 without going through Step S22, in the case of determining that the case of the $H_2$/CO ratio inside the gasification furnace 30 is equal to the target value (YES in Step S20).

In Step S23, the processing unit 70 executes hydrogen supply processing according to steady operation which does not change the hydrogen supply amount, and repeats processing from Step S11 after a predetermined time period elapse.

Next, an example of the flow of the hydrogen supply processing executed by the processing unit 70 after switching the hydrogen introduction location to the first synthesis gas flow passage 81 in Step S18 will be explained while referencing FIG. 9.

As shown in FIG. 9, in Step S31, the furnace external $H_2$/CO information acquisition unit 702 acquires furnace external $H_2$/CO information indicating the $H_2$/CO ratio in the first synthesis gas flow passage 81 detected by the furnace external $H_2$/CO sensor 37.

In Step S32, the hydrogen supply amount adjustment unit 704 determines whether the $H_2$/CO ratio of the first synthesis gas flow passage 81 is no more than the target value, by comparing the furnace external $H_2$/CO information acquired in Step S31 and the target value extracted from the storage unit 72. The hydrogen supply amount adjustment unit 704 advances the processing to Step S33, in the case of determining that the $H_2$/CO ratio of the first synthesis gas flow passage 81 exceeds the target value (NO in Step S32). Then, the hydrogen supply amount adjustment unit 704 stops the supply of hydrogen from the hydrogen supply pump 64 to inside the first synthesis gas flow passage 81 in Step S33, and advances the processing to Step S36. On the other hand, the hydrogen supply amount adjustment unit 704 advances the processing to Step S34, in the case of determining that the $H_2$/CO ratio in the first synthesis gas flow passage 81 is no more than the target value (YES in Step S32).

In Step S34, the hydrogen supply amount adjustment unit 704 determines whether the $H_2$/CO ratio in the first synthesis gas flow passage 81 is equal to the target value, by comparing the furnace external $H_2$/CO information acquired in Step S31 and the target value extracted from the storage unit 72. The hydrogen supply amount adjustment unit 704 advances the processing to Step S35, in the case of determining that the $H_2$/CO ratio in the first synthesis gas flow passage 81 differs from the target value (NO in Step S34). Then, in Step S35, the hydrogen supply amount adjustment unit 704 increases the hydrogen supply amount, and advances the processing to Step S36. On the other hand, the hydrogen supply amount adjustment unit 704 advances the processing to Step S36 without going through Step S35, in the case of determining that the $H_2$/CO ratio in the first synthesis gas flow passage 81 equals the target value (YES in Step S34).

In Step S36, the CO byproduct information acquisition part 703 acquires the CO information indicating the CO amount inside the gasification furnace 30, and byproduct information indicating the byproduct amount inside the gasification furnace 30.

In Step S37, the hydrogen supply location switching part 705 obtains the ratio of Δ CO/Δ byproduct from the CO information and the byproduct information acquired in Step S36, and determines whether this ratio of Δ CO/Δ byproduct is larger than a second switching determination value that is a predetermined value. The hydrogen supply location switching part 705 returns the processing to Step S31, in the case of determining that the ratio Δ CO/Δ byproduct is no more than the second switching determination value (NO in Step S37). On the other hand, the hydrogen supply location switching part 705 advances the processing to Step S38, in the case of determining that the ratio Δ CO/Δ byproduct exceeds the second switching determination value (YES in Step S37). It should be noted that, in the example shown in FIG. 9, the second switching determination value is set to a value higher than the first switching determination value; however, the first switching determination value and the second switching determination value may be equal.

In Step S38, the hydrogen supply location switching part 705 controls the opening/closing operation of the flow switching valve 653, and switches the hydrogen supply location by the hydrogen supply pump 64 from inside the first synthesis gas flow passage 81 to inside the gasification furnace 30. Then, the processing unit 70 returns the processing to Step S11 shown in FIG. 8.

According to the fuel production system 1 related to the present embodiment, the following effects are exerted.

The fuel production system 1 according to the present embodiment is a fuel production system 1 for producing a liquid fuel from a biomass raw material, and includes: the gasification furnace 30 which gasifies the biomass raw material and generates a synthesis gas containing hydrogen and carbon monoxide; the liquid fuel production device 4 which produces a liquid fuel from the synthesis gas generated by the gasification furnace 30; the hydrogen supply pump 64 which supplies hydrogen to the raw material supply area A including inside the gasification furnace 30 and inside the raw material supply path 20 of biomass raw material reaching the gasification furnace 30, or the synthesis gas discharge area B at which the synthesis gas is discharged from the gasification furnace 30; the byproduct sensor 313 which detects a byproduct amount generated inside the gasification furnace 30; and the controller 7 which switches the hydrogen supply location by the hydrogen supply pump 64 between the raw material suppl area A and synthesis gas discharge area B based on the byproduct amount detected by the byproduct sensor 313.

Herein, as mentioned above in the examples shown in FIG. 3 to FIG. 6, although it is possible to suppress the generated amount of carbon dioxide by supplying hydrogen to the gasification furnace 30, the supplied hydrogen is consumed in byproduct generation according to the operating conditions of the gasification furnace 30, and an increased amount of carbon monoxide of high fuel yield may decrease. In contrast, with the fuel production system 1, based on the byproduct amount generated inside the gasification furnace 30, the hydrogen supply location is switched between the raw material supply area A at which hydrogen is supplied to the gasification furnace 30 and the synthesis gas discharge area B which is downstream of the gasification furnace 30. It is thereby possible to curb the carbon dioxide amount generated inside the gasification furnace 30 while adjusting the $H_2$/CO ratio in the synthesis gas by setting the hydrogen supply location to the raw material supply area A, and switch the hydrogen supply location to the downstream side of the gasification furnace 30, when the byproduct amount generated by the hydrogen supply inside the gasification furnace 30 increased. In other words, in the case of the suppression effect of the generated amount of carbon dioxide and the generation efficiency of the carbon monoxide by the hydrogen supply to the gasification furnace 30 declining, it is possible to switch the hydrogen supply location to the downstream side of the gasification furnace 30 at which the generation of the byproduct does not occur, and use the hydrogen only in the adjustment of the $H_2$/CO ratio. Consequently, it is possible to efficiently perform adjustment by hydrogen supply of the composition of the synthesis gas supplied to the liquid fuel production device 4, while suppressing the generated amount of carbon dioxide by the system overall. In addition, since the generated amount of byproduct can also be suppressed, the processing cost can also be reduced. Therefore, it is possible to maximize the improvement effect on the fuel production efficiency by the hydrogen supply, while suppressing the generated amount of carbon dioxide by the system overall.

In addition, the fuel production system 1 according to the present embodiment further includes the electrolyzer 60 which generates hydrogen from water by way of electric power produced using a renewable energy, in which the hydrogen supply pump 64 supplies the hydrogen generated by the electrolyzer 60 to the raw material supply area A or synthesis gas discharge area B. It is thereby possible to further suppress the generated amount of carbon dioxide by the system overall.

In addition, in the fuel production system 1 according to the present embodiment, the controller 7 switches the hydrogen supply location by the hydrogen supply pump 64 from the raw material supply area A to the synthesis gas discharge area B, when the byproduct amount detected by the byproduct sensor 313 is at least a predetermined value. It is thereby possible to perform adjustment of synthesis gas composition and suppression of the generated amount of carbon dioxide by supplying hydrogen to the gasification furnace 30, and in the case of the byproduct amount becoming large, switch so as to use hydrogen only in the adjustment of the synthesis gas composition. It is thereby possible to efficiently perform adjustment of synthesis gas composition by hydrogen supply, while suppressing the carbon dioxide amount generated from the gasification furnace 30.

In addition, in the fuel production system 1 according to the present embodiment, the controller 7 switches the hydrogen supply location by the hydrogen supply pump 64 from the raw material supply area A to the synthesis gas discharge area B, when the byproduct amount per unit time detected by the product sensor 313 is at least a predetermined value. It is thereby possible to switch the hydrogen supply location to the synthesis gas discharge area B at a more appropriate timing, by considering the generated amount of byproduct and generation rate.

In addition, the fuel production system 1 according to the present embodiment further includes the CO sensor 312 which detects the carbon monoxide amount generated in the gasification furnace 30, in which the controller 7 switches the hydrogen supply location by the hydrogen supply pump 64 from the raw material supply area A to the synthesis gas discharge area B, when the ratio of the carbon monoxide amount per unit time detected by the CO sensor 312 relative to the byproduct amount per unit time detected by the byproduct sensor 313 is at least the first switching determination value. It is thereby possible to switch the hydrogen supply location to the synthesis gas discharge area B at a more appropriate timing by considering the generated amounts of byproduct and carbon monoxide having high fuel yield and the generation rate.

In addition, in the fuel production system 1 according to the present embodiment, the controller 7 controls the hydrogen supply amount by the hydrogen supply pump 64, and adjusts the $H_2$/CO ratio of synthesis gas flowing to the synthesis gas discharge area B. Even in the case of switching the hydrogen supply location to the downstream side from the gasification furnace 30, it is thereby possible to more reliably supply synthesis gas of the desired $H_2$/CO ratio to the liquid fuel production device 4.

In addition, the fuel production method according to the present embodiment produces a liquid fuel from a biomass raw material, the method including: a synthesis gas generating step of gasifying the biomass raw material and generating synthesis gas containing hydrogen and carbon monoxide by the gasification furnace 30; a liquid fuel producing step of producing a liquid fuel from the synthesis gas generated in the synthesis gas generating step; a hydrogen supply step of supplying hydrogen from the raw material supply area A including inside the gasification furnace 30 and inside the raw material supply path 20 of the biomass raw material reaching the gasification furnace 30, or the synthesis gas discharge area B at which the synthesis gas is discharged from the gasification furnace 30; a byproduct detecting step of detecting a byproduct amount generated in the synthesis gas generating step; and a switching step of switching the hydrogen supply location in the hydrogen supplying step between the raw material supply area A and the synthesis gas discharge area B, based on the byproduct amount detected in the byproduct detecting step. It is thereby possible to efficiently perform adjustment by hydrogen supply of the composition of synthesis gas used in the production of liquid fuel, while suppressing the generated amount of carbon dioxide by the system overall. In addition, since the generated amount of byproduct can also be suppressed, the processing cost can also be reduced. Therefore, it is possible to maximize the improvement effect on the fuel production efficiency by the hydrogen supply, while suppressing the generated amount of carbon dioxide by the system overall.

Although an embodiment of the present invention has been explained above, the present invention is not to be limited thereto. The configurations of detailed parts may be modified as appropriate within the scope of the gist of the present invention.

EXPLANATION OF REFERENCE NUMERALS

1 fuel production system
4 liquid fuel production device
7 controller
20 raw material supply path
30 gasification furnace
60 electrolyzer
64 hydrogen supply pump (hydrogen supply device)
313 byproduct sensor (byproduct detector)
A raw material supply area
B synthesis gas discharge area

What is claimed is:

1. A fuel production system for producing a liquid fuel from a biomass raw material, the system comprising:

a gasification furnace which gasifies a biomass raw material to generate a synthesis gas containing hydrogen and carbon monoxide;

a liquid fuel production device which produces a liquid fuel from the synthesis gas generated by the gasification furnace;

a hydrogen supply device which supplies hydrogen to a raw material supply area including inside the gasification furnace and inside a raw material supply path of biomass raw material leading to the gasification furnace, or a synthesis gas discharge area at which the synthesis gas is discharged from the gasification furnace;

a byproduct detector which detects a byproduct amount generated within the gasification furnace; and a controller which switches a hydrogen supply location by the hydrogen supply device between the raw material supply area and the synthesis gas discharge area, based on the byproduct amount detected by the byproduct detector, wherein the byproduct amount includes an amount of at least one byproduct selected from the group consisting of methane, tar, and char.

2. The fuel production system according to claim 1, further comprising an electrolyzer which generates hydrogen from water by way of electrical power generated using a renewable energy, wherein the hydrogen supply device supplies the hydrogen generated by the electrolyzer to the raw material supply area or the synthesis gas discharge area.

3. The fuel production system according to claim 1, wherein the controller switches a hydrogen supply location by the hydrogen supply device from the raw material supply area to the synthesis gas discharge area, when a byproduct amount detected by the byproduct detector is at least a predetermined value.

4. The fuel production system according to claim 1, wherein the controller switches a hydrogen supply location by the hydrogen supply device from the raw material supply area to the synthesis gas discharge area, when a byproduct amount per unit time detected by the byproduct detector is at least a predetermined value.

5. The fuel production system according to claim 1, further comprising a carbon monoxide detector which detects a carbon monoxide amount generated in the gasification furnace, wherein the controller switches a hydrogen supply location by the hydrogen supply device from the raw material supply area to the synthesis gas discharge area, when a ratio of carbon monoxide amount per unit time detected by the carbon monoxide detector relative to a byproduct amount per unit time detected by the byproduct detector is at least a predetermined value.

6. The fuel production system according to claim 1, wherein the controller controls a hydrogen supply amount by the hydrogen supply device to adjust an $H_2/CO$ ratio of synthesis gas flowing to the synthesis gas discharge area.

7. A fuel production method for producing a liquid fuel from a biomass raw material, the method comprising:

a synthesis gas generating step of gasifying the biomass raw material and generating a synthesis gas containing hydrogen and carbon monoxide in a gasification furnace;

a liquid fuel producing step of producing the liquid fuel from the synthesis gas generated in the synthesis gas generating step;

a hydrogen supplying step of supplying hydrogen to a raw material supply area including inside of the gasification furnace and inside a raw material supply path of the biomass raw material leading to the gasification furnace, or to a synthesis gas discharge area at which the synthesis gas is discharged from the gasification furnace;

a byproduct detecting step of detecting a byproduct amount generated in the synthesis gas generating step; and a switching step of switching a hydrogen supply location by the hydrogen supplying step between the raw material supply area and the synthesis gas discharge area, based on the byproduct amount detected in the byproduct detecting step, wherein the byproduct amount includes an amount of at least one byproduct selected from the group consisting of methane tar, and char.

* * * * *